United States Patent [19]

Neckamm et al.

[11] Patent Number: 4,863,162

[45] Date of Patent: Sep. 5, 1989

[54] GYMNASTICS APPARATUS

[75] Inventors: Harald Neckamm; Radko Pavlovec; Johann Zotter, all of Vienna; Hubert Wuerthner, Hainburg/Donau, all of Austria; Anders Dyne, Gothenburg, Sweden

[73] Assignee: TMC Corporation, Baar, Switzerland

[21] Appl. No.: 840,504

[22] Filed: Mar. 17, 1986

[30] Foreign Application Priority Data

Mar. 18, 1985 [AT] Austria ..... 796/85
May 10, 1985 [AT] Austria ..... 1409/85

[51] Int. Cl.[4] ..... A63B 21/00; A63B 23/02

[52] U.S. Cl. ..... 272/137; 272/141; 128/75

[58] Field of Search ..... 272/93, 109, 62, 63, 272/74, 114, 67, 100, 137, 141, DIG. 4, 135, 136, 138, 139, 140, 142, 125, 126; 403/108, 325, 322; 128/75, 71

[56] References Cited

U.S. PATENT DOCUMENTS 412,772 10/1889 Medart ..... 272/63
1,023,756 4/1912 Pons ..... 272/141
2,223,309 11/1940 Swanson ..... 272/141
2,497,319 2/1950 Mott ..... 403/108
2,817,522 12/1957 Margulies ..... 272/62
4,114,873 9/1978 Jones ..... 272/63
4,517,966 5/1985 von Othegraven ..... 272/137

FOREIGN PATENT DOCUMENTS 1012574 6/1977 Canada ..... 272/141

*Primary Examiner*—S. R. Crow
*Attorney, Agent, or Firm*—Flynn, Thiel, Boutell & Tanis

[57] ABSTRACT

A gymnastics apparatus having a support rod and a handle bar movable toward and away from one another against the force of a spring. A connecting rod and a pipe is arranged between the support rod and the handle bar, the pipe surrounding the connecting rod and housing the spring. A spring abutment member which opposes the connecting rod can be adjusted in an axial direction in the pipe and can be fixed relative to the pipe. In order to facilitate, in such a gymnastics apparatus, an adjustment to various body sizes, the invention provides that the connecting rod is connected, if desired hingedly, to the support rod and the pipe to the handle bar.

12 Claims, 10 Drawing Sheets

GYMNASTICS APPARATUS

FIELD OF THE INVENTION

The invention relates to a gymnastics apparatus for exercising parts of the body, particularly the back muscles.

BACKGROUND OF THE INVENTION

A gymnastics apparatus is described in Austrian Pat. No. 377 182 (compare also British Pat. No. 2 114 456). This apparatus primarily serves to stretch and strengthen the back muscles. An adjusting of the connecting rod relative to the pipe which surrounds the connecting rod is, however, slightly complicated in this apparatus, because the clamping device, which holds the connecting rod relative to the pipe in the adjusted position, must, during the adjusting operation, be moved up and down together with the handle bar and then be operated.

The purpose of the invention is to overcome this disadvantage and to provide a gymnastics apparatus of the abovedisclosed type, in which the distance between handle bar and support rod can be adjusted substantially easier.

This purpose is inventively attained by connecting, if desired hingedly, the connecting rod to a support rod and the pipe to the handle bar. Through this, the number of operating steps needed for the adjustment are reduced.

The gymnastics apparatus is substantially protected against environmental influences by encasing the pipe in plastic.

The provision of a pivotally supported lever connected to a locking bolt enables a substantially simpler adjustment of the pipe and connecting rod than is possible in the known design, in which a hexagon cap screw or a turning handle must be tightened at the end of the adjusting operation.

In the inventive construction, it is preferable for the spring to be arranged between the end of the connecting rod and a spring abutment member constructed as a guide member for the locking bolt. Thus the guide member has to fulfill two functions, namely to guide the bolt for locking and to support the spring.

Through the provision of an inventive locking lever construction, the forces in direction of the encasing pipe axis are absorbed by a bearing, which bearing can be of a large construction, and a jamming of the lever within the housing cannot occur.

Several practical designs of a guideway for a pin on the locking bolt can be provided. A one piece two-arm lever is particularly preferable and can therefore be easily manufactured. Furthermore, the lever can be provided with an indicating device indicating whether or not the device is locked or unlocked.

BRIEF DESCRIPTION OF THE DRAWINGS

Embodiments of the subject matter of the invention are illustrated exemplary in the drawings in which.

DETAILED DESCRIPTION

Figure 1:
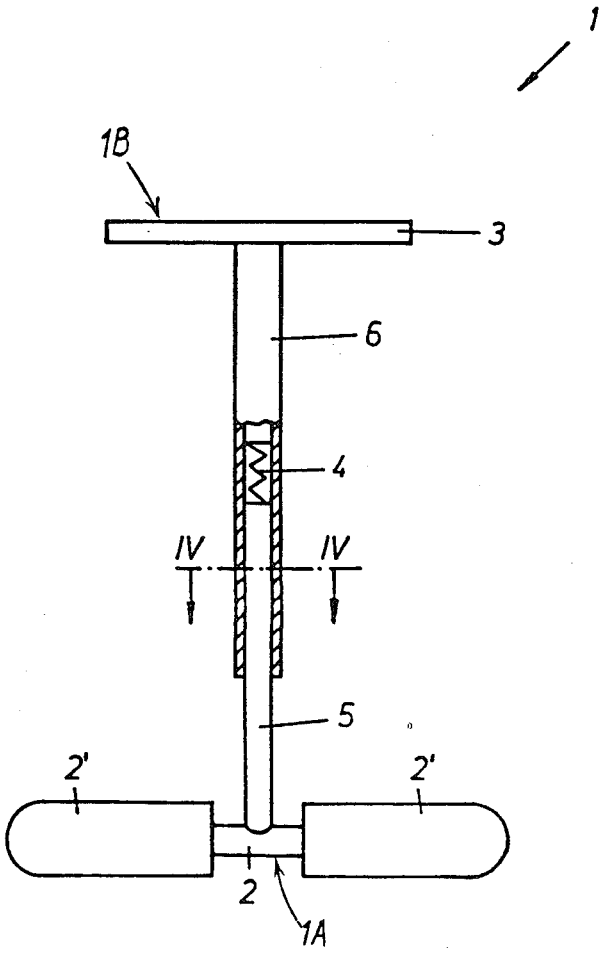
FIG. 1 is a partially cross-sectioned, substantiality reduced front view of the inventive principle.

FIG. 1 illustrates a gymnastics apparatus in its entirety by the reference numeral 1, partly without inventively important details which are illustrated in the following figures. The gymnastics apparatus has two T-shaped members 1A and 1B which are connected to one another. More specifically, the T-shaped member 1A has a support bar or rod 2 defining the cross bar of the T and a connecting rod 5 defining the stem portion of the T. The ends of the support bar 2 are each provided with cushions 2'. The T-shaped member 1B has a handle bar 3 defining the cross bar of the T and a pipe member 6 defining the stem portion of the T. The connecting rod 5 is slidably received in the pipe member 6 with a normal clearance being provided therebetween so as to prevent any substantial shifting out of concentric alignment. A spring 4 is positioned inside the pipe member 6 and is positioned so as to be compressed as the handle bar 3 and the support rod or bar 2 are moved toward one another.

Figure 2:
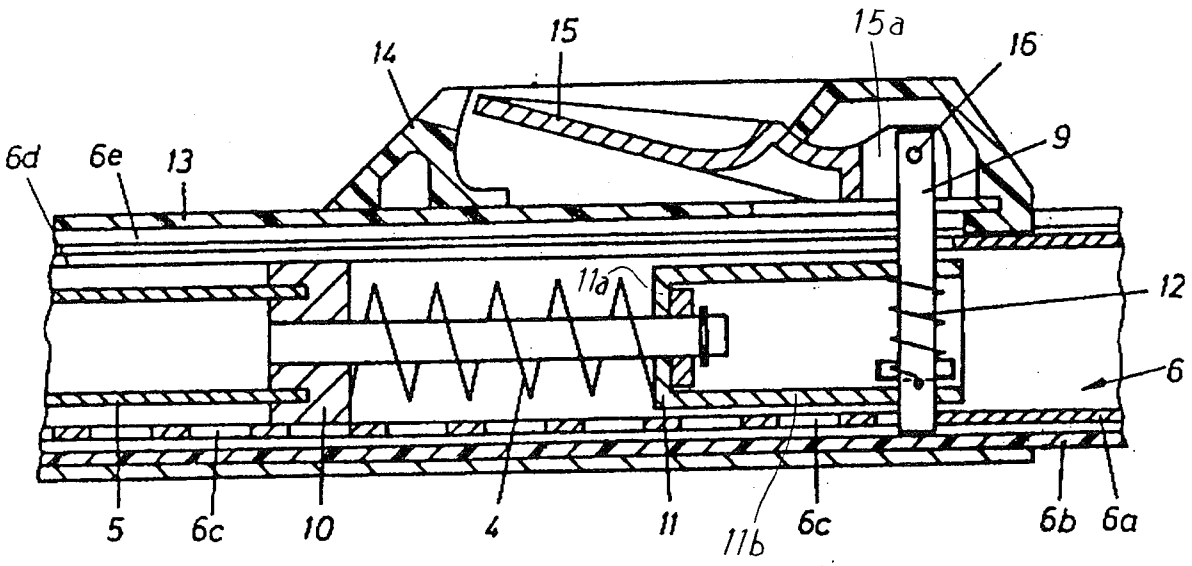
FIG. 2 is a fragmentary longitudinal cross-sectional view of a locking device.
Figure 3:
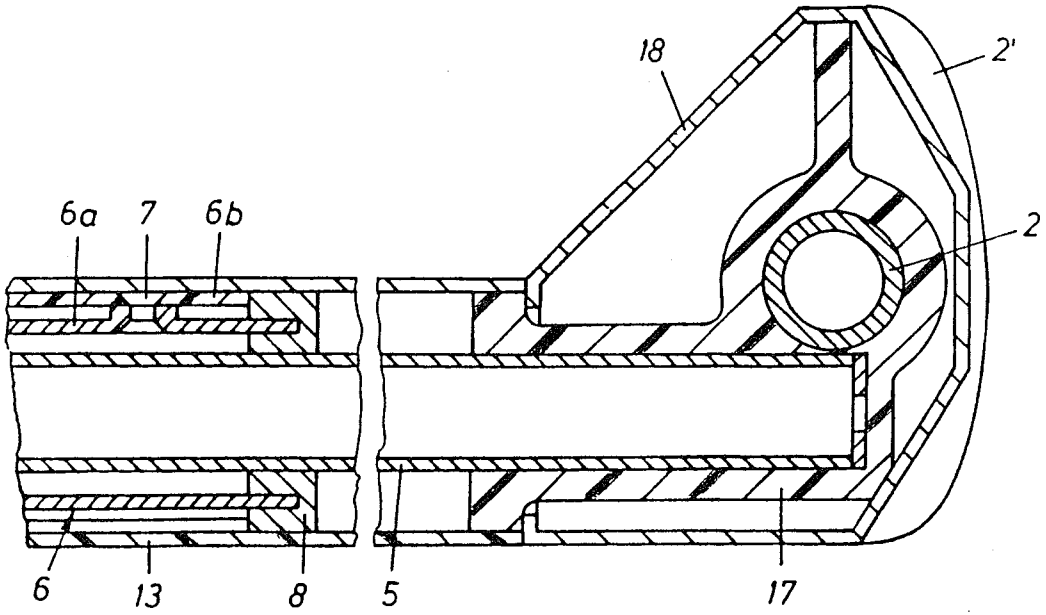
FIG. 3 is a fragmentary longitudinal cross-sectional view of the lower end of the connecting rod.
Figure 4:
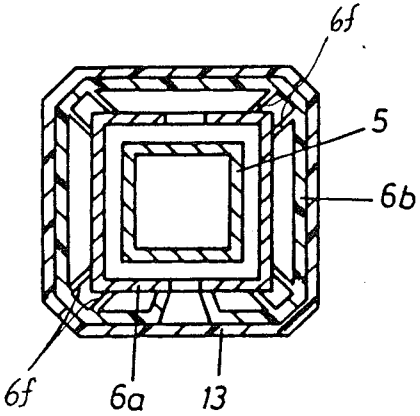
FIG. 4 is an enlarged cross-sectional view taken along the line IV—IV of FIG. 1.

A more detailed showing of the structural design of the inventive gymnastics apparatus is illustrated in FIGS. 2–3. As can be seen from these figures, the pipe member 6 consists of a square inner pipe 6*a* made of metal and of an approximately square outer pipe 6*b* made of plastic. The outer pipe 6*b* has inwardly projecting shoulders 6*f* (FIG. 4) which engage the outer wall of the inner pipe 6*a*. Both pipes 6*a* and 6*b* are connected to each other at their end which is remote from the handle bar 3, for example by a rivet 7 (FIG. 3). The inner pipe 6*a* is anchored in a piston-like frame 8 which can slide along the inside of the connecting rod 5.

The inner pipe 6*a* has a row of holes 6*c* in one wall thereof, each being adapted to receive therein a locking bolt 9 to facilitate a locating of the handle bar 3 and the support bar 2 at different distances from one another. The two pipes 6*a* and 6*b* are each provided with a longitudinally extending slots 6*d* and 6*e*, respectively, on a side remote from or opposite the row of holes 6*c*. The longitudinal slots 6*d* and 6*e* permit a movement of the locking bolt 9 therein in direction of the axis of the connecting rod 5. For reasons of reducing the weight of the apparatus, the connecting rod 5 is provided with a square hollow profile. A piston 10 is arranged at the upper end of the connecting rod 5, on which piston one end of the spring 4 is supported. The other end of the spring 4 rests against a spring abutment 11, namely, the bottom wall 11*a* of a cupshaped sleeve member 11*c*. The locking bolt 9 is supported for movement on the spring abutment 11 transversely with respect to the connecting rod 5. The locking bolt 9 is under the influence of a pressure spring 12, which continually urges it into the locking position.

The outer pipe 6*b* is movably supported in an approximately square encasing pipe 13 made of plastic. A plastic housing 14 is secured to said encasing pipe. A two-arm lever 15 is pivotally supported on the housing 14. The leveraged arm 15*a* of the two-arm lever is hingedly connected by a pin 16 to one end of the bolt 9. If in the inventive gymnastics apparatus the distance between the handle bar 3 and the support rod 2 is supposed to be changed, then the leveraged arm 15*a* of the lever 15 is pressed down by the finger of the user to leverage the arm 15*a* laterally outwardly to lift or pull the bolt 9 out of the associated hole of the row of holes 6*c*. However, as soon as the desired distance between the handle bar 3 and support rod 2 is established, the lever 15 is released by the hand of the user, and the pressure spring 12 urges the bolt 9 into the appropriate hole of the row of holes 6*c* corresponding to the adjusted distance. In this manner, a new spacing between the handle bar 3 and the support rod 2 is determined and the gymnastics apparatus can again be used.

The support rod 2, having a cushion 2' at its two ends, has its center area inserted into a plastic member 17. The ends of the connecting rod 5 and the encasing pipe 13 are also connected to the plastic member 17. A cover is identified by the reference numeral 18, which cover surrounds the plastic member 17 partly at a distance and which is connected to the encasing pipe 13. The encasing pipe 13 has, adjacent the bolt 9, a not illustrated window for enabling a reading of a not illustrated scale mounted on the outer pipe 6*b*. This scale makes the adjusting of the desired distance between the handle bar 3 and the support rod 2 easier.

The connection of the handle bar 3 with the two pipes 6*a* and 6*b* is similar to the described connection of support rod 2, connecting rod 5 and encasing pipe 13. The ends of the pipes 6*a* and 6*b* are thereby supported in a frame which is square in the top view and which is connected to a plastic part having a bore which receives the handle bar 3 therein. Since this connection, however, is not the subject matter of the invention, the connection is not illustrated in the drawings.

Figure 5:
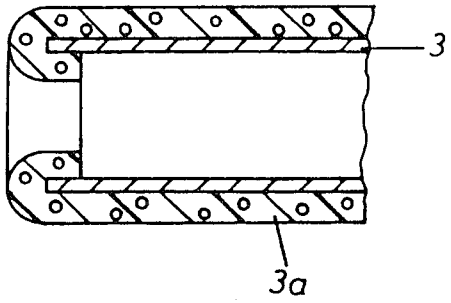
FIG. 5 is a longitudinal cross-sectional view of an end fragment of the handle bar.

In order to prevent the formation of callouses on the surfaces of the hands during a use of the apparatus, the handle bar 3 is provided with a sleeve 3*a* made of a foamed plastic in the area of the gripping surfaces of the hands of the user (FIG. 5).

Figure 6:
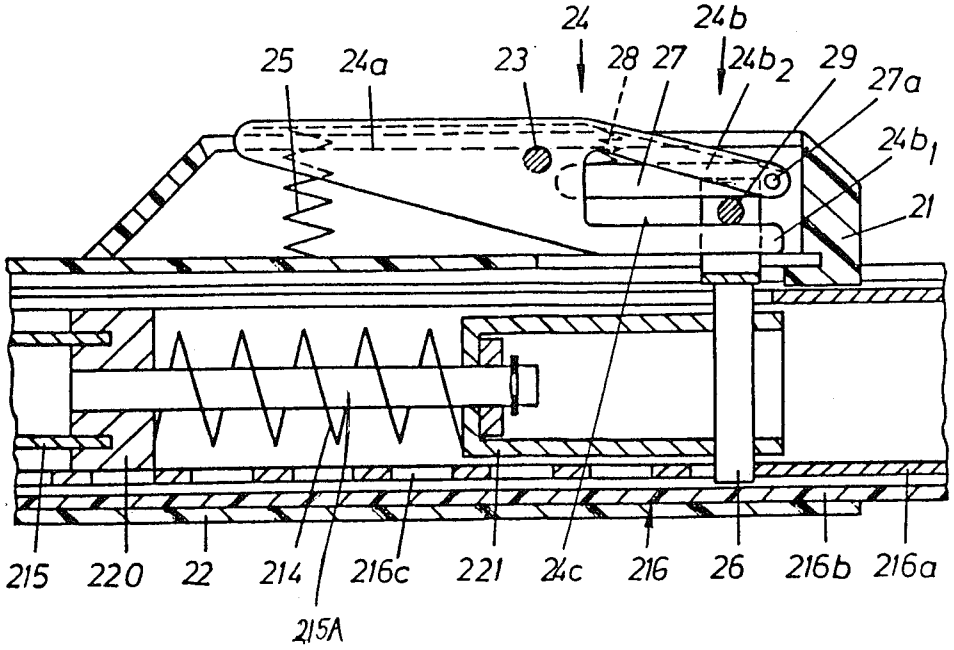
FIG. 6 is a fragmentary longitudinal cross-sectional view of a further locking device in the locking position.
Figure 7:
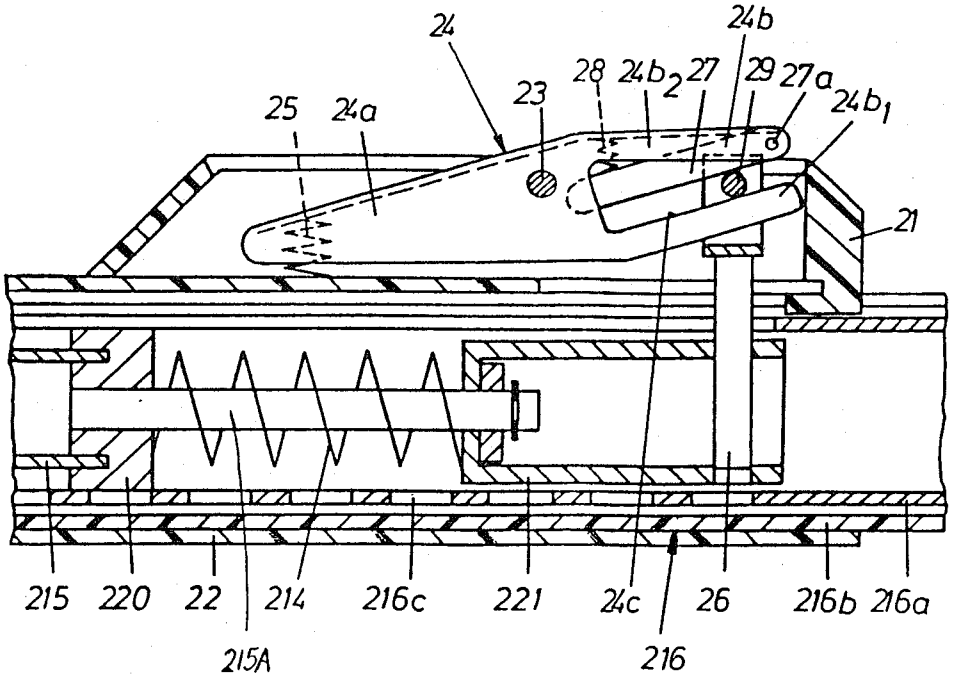
FIG. 7 is the same view as in FIG. 6 but showing the locking device in the unlocked position.
Figure 8:
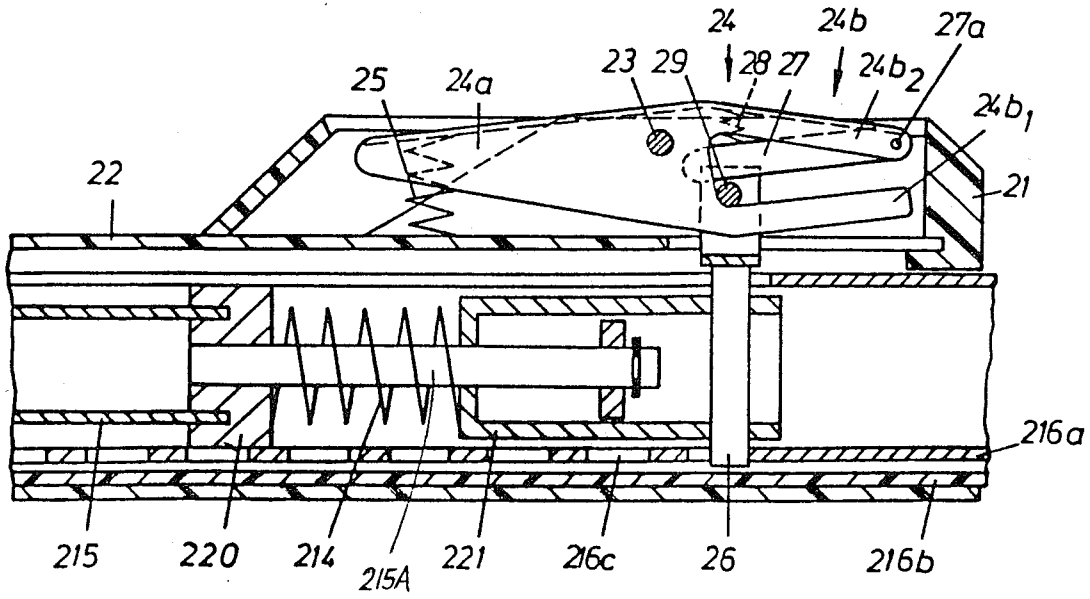
FIG. 8 illustrates the two-arm lever of the locking device in an intermediate position.

In place of the housing 14, another type of housing can be provided and which has an opening for a bolt 26. This other type of housing is identified by the reference numeral 21 in FIGS. 6–8. The housing 26 is secured to an encasing pipe 22. The housing 21 supports an axle 23 which extends parallel to the tangent to the encasing pipe 22. A pin 29 similar to the axle 23 is provided on one arm 24*b* of a two-arm lever 24 pivotally supported on the housing 21. The lever arm 24*a*, which is at the left end in FIGS. 6 to 8, is adapted to be engaged by a finger of the user. The lever arm 24*a*, when viewed in the direction of the axis of the axle 23, has a wedge-shape and is under the influence of a spring 25 which urges it away from the encasing pipe 22. The right lever arm 24*b* has the shape of a fork having a prong $24b_1$ which is adjacent to the encasing pipe and which extends, in the engaged or locking position of the locking bolt 26, parallel to the encasing pipe 22. The other prong $24b_2$ defines an acute angle with the encasing pipe axis (FIG. 6). In this manner an approximately trapezoidally shaped space is formed between th prongs $24b_1$ and $24b_2$, the one side of which space serves as a guideway 24*c* for the transversely extending pin 29 which will yet be described below.

A one-arm lever 27 is hingedly connected to the free end of the prong $24b_2$ by means of an axle 27*a*, which lever 27 is under the influence of a helical spring 28 which urges it against the other prong $24b_1$. The transversely extending pin 29 between the one-arm lever 27, which forms one side of a guideway 24*c* and the prong $24b_1$ which forms the other side of the guideway. The pin 29 is secured to the upper end of the locking bolt 26 which, in this embodiment, has a fork shaped end. However, there also exists the possibility of making the locking bolt cylindrical throughout and to weld its upper end to the pin 29. Viewed in direction of the longitudinal axis of the encasing pipe 22, the two-arm lever 24 has a U-shape, so that it can receive within the U the two springs 25 and 28 and the one-arm lever 27.

The connecting rod is identified by the reference numeral 215. The connecting rod 215 has a piston-like wall 220 at its right end on which is supported one end of a pressure spring 214. The other end of the pressure spring 214 rests on a spring abutment member 221 constructed in the form of a cup-shaped sleeve. The spring abutment device is connected to the piston-like wall 220 by an elongated pin 215A. The spring 214 encircles the pin 215A. The locking bolt 26 is supported for movement in a direction that is transverse to the longitudinal axis of the abutment member 221 and is received a pair of axially aligned holes in the abutment member 221. The locking bolt 26 is under the influence of the pressure spring 25 which urges it into the locking position, that is, a position received in the aligned holes.

A pipe 216 is arranged in the plastic encasing pipe 22. The encasing pipe 22 is approximately square in cross section. The pipe 216 consists of a square inner pipe 216*a* made of metal and an approximately square outer pipe 216*b* made of plastic. Not illustrated inwardly projecting shoulders on the outer pipe 216*b* rest on the outside surface of the inner wall of the inner pipe 216*a*. Both pipes 216*a* and 216*b* are connected to one another at their left end by a not illustrated rivet. The inner pipe 216*a* has a longitudinally extending row of holes 216*c*, a selected one of which receives therein an end of the locking bolt 26 to facilitate a spacing of the not illustrated support bar at various distances from the handle bar. On the side of the two pipes 216*a* and 216*b* remote from the row of holes 216*a* and 216*b*, there is provided a longitudinal slot which allows a movement of the locking bolt 26 in a direction of the longitudinal axis of the connecting rod 215.

Figure 6A:
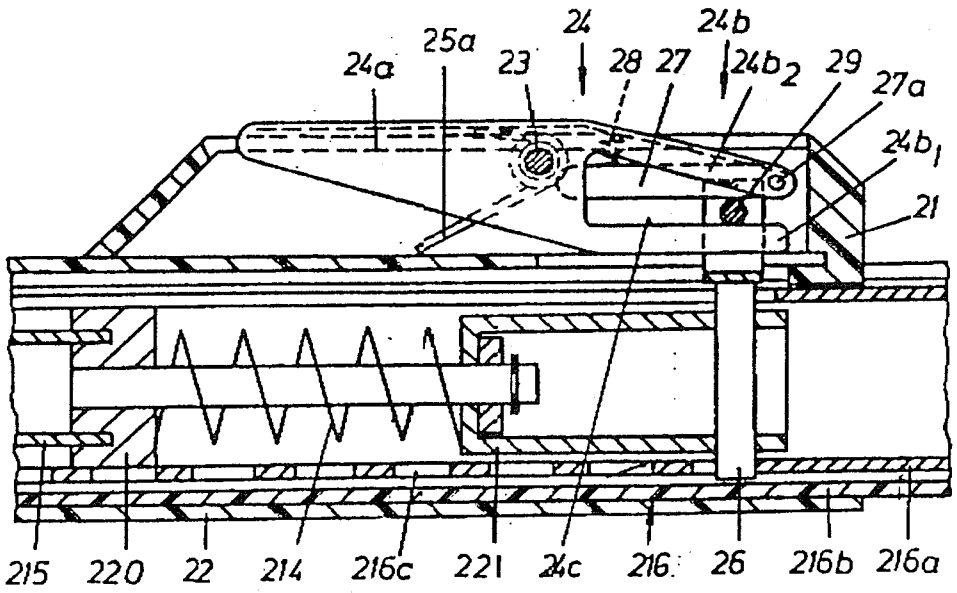
FIG. 6*a* is a fragmentary longitudinal cross-sectional view of a further locking device similar to FIG. 6 but showing a torsion spring biassing the two-arm lever.

During a use of the gymnastics apparatus, the individual elements assume the position which is illustrated in FIG. 6. If, however, the distance between the handle bar and the support rod is supposed to be changed in the apparatus, then the lever arm 24*a* is pressed down by the user against the force of the compression-spring 25 (or torsion spring 25*a* in FIG. 6*a*) and through this the locking bolt 26 is pulled out of the illustrated hole of the row of holes 216*c* (see FIG. 7). This causes the connection between the connecting rod 215 and the pipe 216 to be released.

As soon, however, as the desired distance between the handle bar 3 and the support rod 2 is reached, the lever 24 is released by the user, and the spring 25 urges the locking bolt 26 into the corresponding hole of the row of holes 216*c*. In this manner, the new distance between the handle bar 3 and the support rod 2 is fixed and the gymnastics apparatus can again be used.

If during a careless use by the user the locking bolt 26 is not in a correct engagement with its seat, the pin 29 could lock in its guide. The application of a force by the locking bolt 26 onto the lever 24 or axle 23 is also to be avoided. For this reason, the pin 29, which extends through the locking bolt 26 in a transverse direction of the housing 21, is guided between the two fork prongs 24*b*$_1$ and 24*b*$_2$ of the lever arm 24. Since, however, the two fork prongs 24*b*$_1$ and 24*b*$_2$ define an angle with one another, an orderly guiding of the pin 29 would not be assured due to the distance between the fork prongs. In order to overcome this deficiency, the one-arm lever 27 is provided. The lever 27 is urged by the spring 28 into engagement with the pin 29 at all times to hold the pin 29 in contact with the fork prong 24*b*$_1$. As soon as the lower end of the locking bolt 26 approaches the row of holes 216*c*, the locking bolt is, when the two-arm lever 24 is released by the user, urged into a hole 216*c* of the row of holes, through which the connection between the connecting rod 215 and the pipe 216 is again established (see FIG. 8).

Figure 9:
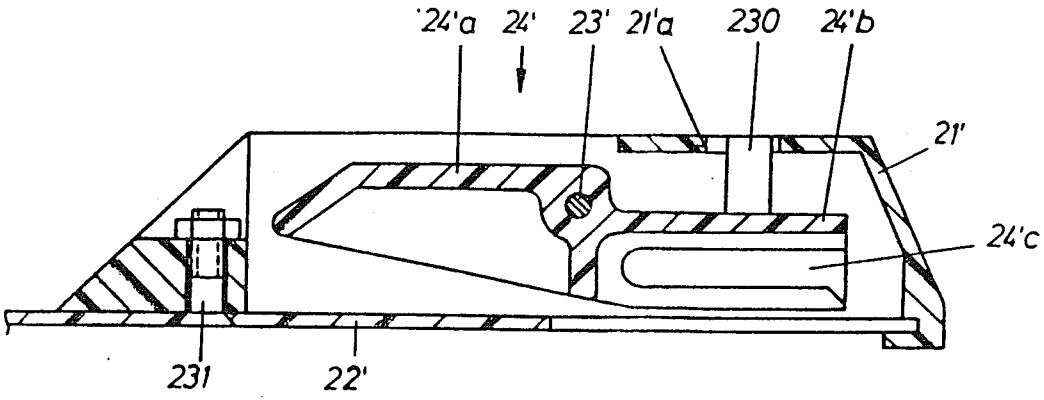
FIG. 9 is a central longitudinal cross-sectional view of a further embodiment of a two-arm lever which is housed in a housing.

In the exemplary embodiment according to FIG. 9, a one-piece plastic two-arm lever 24' is supported in a housing 21' on an axle 23'. The lever 24' has a force arm 24'*a* and a load arm 24'*b*, the upper side of which carries an indicating device in the form of an upwardly projecting button 230 which extends through a bore 21'*a* in the housing 21'. With the help of this indicating device, it can be determined whether or not the gymnastics apparatus is locked orderly through the engagement of the locking bolt with the row of holes.

The load arm 24'*b* is approximately U-shaped in cross section with two downwardly depending legs. The two legs each have a longitudinally extending guideway 24'*c* therein constructed as a groove which opens toward a central longitudinal plane. The ends of the pin 29 on the locking bolt are received and guided in the guideways 24'*c*. The housing 21' is, in the illustrated exemplary embodiment, hooked at one end (the right end in FIG. 9) to the encasing pipe 22' and is secured at the other end by means of a screw 231 to the encasing pipe 22'. However, there exists the possibility to glue the housing 21' to the encasing pipe 22'.

Figure 10:
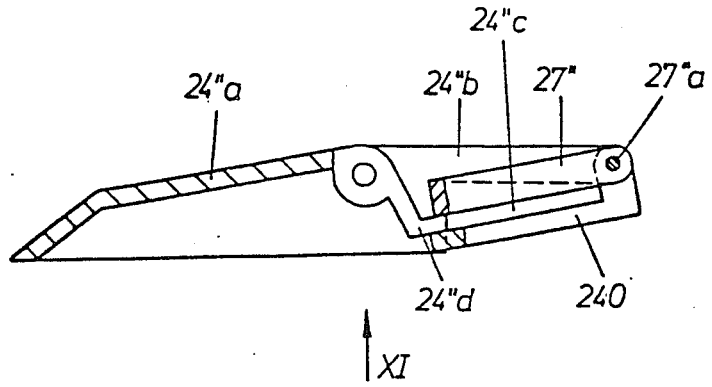
FIG. 10 is a further exemplary embodiment of a two-arm locking lever by itself and in cross section taken along the line X—X of FIG. 11.
Figure 11:
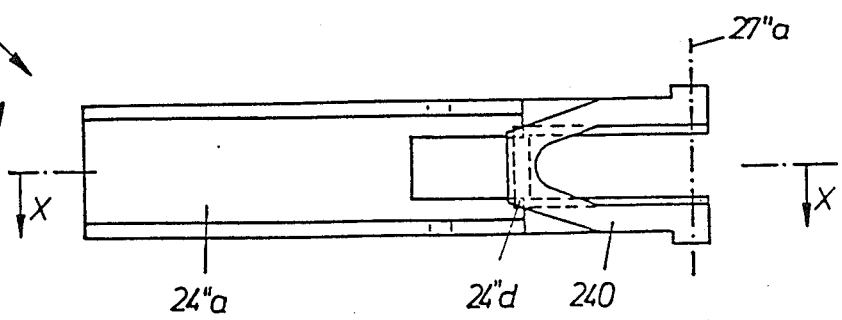
FIG. 11 is a front view of the two-arm lever of FIG. 10 as viewed in direction of the arrow XI.
Figure 12:
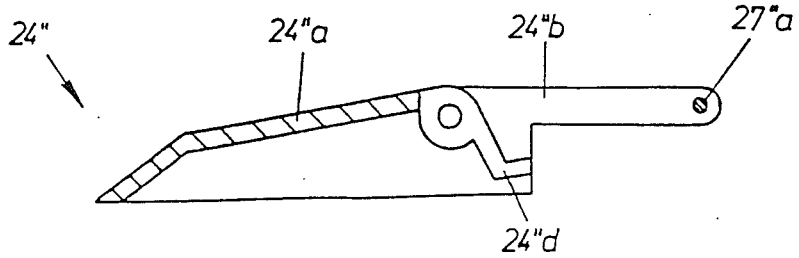
FIG. 12 illustrates a detail of FIG. 10.

A further embodiment of a two-arm lever 24'', which embodiment is illustrated in FIGS. 10 to 12, is similar to the one which is illustrated in FIGS. 6 to 8 in that there is supported at the end of the load arm 24''*b* an axle 27''*a*, to which axle is hingedly secured a one-arm lever 27''. The lever 27'' is under the influence of a not illustrated spring and functions as a moveable edge of a guideway 24''*c* for the pin 29 on the locking bolt 26. However, an angular part 240 is additionally pivotally supported on the axle 27''*a*, the longer leg of which part 240 forms a counter-edge for the aforesaid guideway 24''*c* for the pin of the locking bolt. In order to limit the angle of traverse of the one-arm lever 27'' and of the part 240, a stop 24''*d* is provided on the two-arm lever 24''. The stop 24''*d* has two vertically facing, longitudinally extending surfaces thereon. The upwardly facing surface is engaged by the free end of the lever 27'' and the downwardly facing surface is engaged by the free end of the part 240. FIG. 12 illustrates the two-arm lever 24'' and its stop 24''*d*. The two-arm lever 24' and 24'', according to FIGS. 9 to 11, have the advantage that they can be constructed relatively short and can therefore be housed easier in a flat housing, which housing is open to the outside only in the area of the force arm on the lever.

The operation of the two last-discussed exemplary embodiments corresponds to the aforedescribed embodiment, so that a more detailed discussion should not be needed.

The invention is by no means to be limited to the exemplary embodiment which is illustrated in the drawings and described above. Rather various modifications of the same are possible without departing from the scope of the invention. For example, the spring 4 by no means needs to be a helical spring. Instead, it can be replaced by a rubber member. Furthermore, a set of springs 4 having different spring characteristic and different length can be associated with the apparatus, which set makes possible an individual adjustment of the apparatus to the physical characteristics of the user. Finally, the pressure spring 12 can also be arranged between the pin 16 and the encasing pipe 13.

The embodiments of the invention in which an exclusive property or privilege is claimed are defined as follows:

1. In a gymnastics apparatus for supporting a trunk-bending exercise in which a support rod, designated for resting on the thighs of the user, and a handle bar can be moved toward and away from one another against the force of a spring, by arranging between the support rod and the handle bar a connecting rod and a pipe, said pipe surrounding said connecting rod, said pipe containing said spring, a spring abutment member being provided and opposing said connecting rod and is adjustable in an axial direction in said pipe and can be fixed relative to said pipe by means of a locking device, the improvement comprising wherein said connecting rod is connected to said support rod and said pipe is connected to said handle bar and, wherein said spring abutment member includes connecting means for connecting said spring abutment member to said locking device, wherein said locking device includes a longitudinal slot on one diametrical side of said pipe and means defining a plurality of holes in a row in a side opposing said one diametrical side; and a bolt which is reciprocally movable in said pipe against the force of a pressure spring, said bolt extending through said slot and transversely with respect to a longitudinal axis of said pipe, and which bolt is selectively insertable into a selected one of said plurality of holes in said row to lock said pipe and said connecting rod in a fixed relation to each other.

2. A gymnastics apparatus according to claim 1, wherein said pipe has a substantially square cross section and is movably guided in an encasing pipe which is approximately square in cross section and which is connected to said support rod and carries at its upper end said connecting means for connecting said spring abutment member to said locking device.

3. A gymnastics apparatus according to claim 1, wherein said bolt can be lifted against the force of said pressure spring out of said selected hole by means of a two-arm lever.

4. A gymnastics apparatus according to claim 1, wherein said pipe consists of a metallic inner pipe and an outer pipe which is connected to said inner pipe, wherein said row of holes is provided on said inner pipe and a scale for indicating the adjusted distance from said handle bar and said support rod consists of a spacing between said holes on said outer pipe, and wherein an encasing pipe encircling said inner and outer pipes has means defining a window for reading the adjusted distance at the level of said bolt.

5. A gymnastics apparatus according to claim 2, wherein said spring abutment member is constructed as a guide member for said bolt.

6. A gymnastics apparatus according to claim 3, wherein the two-arm lever is pivotally supported by means of an axle, said axle extending parallel to a side surface of an encasing pipe connected to said support rod and encircling said pipe and is oriented in a housing secured to one end of said encasing pipe, and wherein a load arm of said two-arm lever is provided with an elongated guideway for a pin on said locking bolt, which pin effects a securement of said locking bolt to said load arm, and wherein said encasing pipe is provided with a slot which extends in said axial direction of said pipe and is approximately aligned with said guideway.

7. A gymnastics apparatus according to claim 6, wherein said two-arm lever is constructed in one piece and wherein two laterally spaced guideways are provided in the load arm of said lever, in which guideways the ends of said pin are guidingly received.

8. A gymnastics apparatus according to claim 6, wherein an indicating device is provided on said housing for indicating an unlocked position of said bolt and which is constructed in the form of a button arranged on said two-arm lever and extends through a means defining a window in said housing.

9. A gymnastics apparatus according to claim 6, wherein said load arm of said two-arm lever, viewed in the direction of said axle, is constructed fork-shaped with two fork prongs, and wherein said two fork prongs converge toward their free ends.

10. A gymnastics apparatus according to claim 6, wherein a one-arm lever is hinged to a free end of said load arm of said two-arm lever by means of an axle, said one-arm lever being under the influence of a helical or torsion spring urging it against said pin of said bolt or against a stop.

11. A gymnastics apparatus according to claim 6, wherein a U-shaped part is hinged by means of an axle to said free end of said load arm of said two-arm lever, said U-shaped part having two legs, one of which is longer than the other, a longer leg of said U-shaped part facilitating a guiding of said pin.

12. A gymnastics apparatus according to claim 6, wherein said pressure spring which urges said bolt into said selected hole is a two legged torsion spring which is arranged on said axle of said two-arm lever, one leg of said torsion spring being supported on said encasing pipe and the other leg being supported on a lever arm of said two-arm lever.

* * * * *